US006592938B1

(12) United States Patent
Pessey et al.

(10) Patent No.: US 6,592,938 B1
(45) Date of Patent: Jul. 15, 2003

(54) METHOD FOR COATING PARTICLES

(75) Inventors: Vincent Pessey, Bordeaux (FR); François Cansell, Pessac (FR); Bernard Chevalier, Talence (FR); François Weill, Martignas (FR); Jean Etourneau, Cestas (FR)

(73) Assignee: Centre National de la Recherche Scientifique, Paris (FR)

( * ) Notice: Subject to any disclaimer, the term of this patent is extended or adjusted under 35 U.S.C. 154(b) by 0 days.

(21) Appl. No.: 09/937,748

(22) PCT Filed: Mar. 28, 2000

(86) PCT No.: PCT/FR00/00771

§ 371 (c)(1),
(2), (4) Date: Oct. 1, 2001

(87) PCT Pub. No.: WO00/59622

PCT Pub. Date: Oct. 12, 2000

(30) Foreign Application Priority Data

Apr. 2, 1999 (FR) ..... 99 04175

(51) Int. Cl.[7] ..... B05D 7/00

(52) U.S. Cl. ..... 427/212; 427/215; 427/217; 427/222; 427/250; 427/430.1; 427/435; 427/436; 427/437; 427/443.1

(58) Field of Search ..... 427/212, 215, 427/217, 222, 250, 430.1, 435, 436, 437, 443.1

(56) References Cited

U.S. PATENT DOCUMENTS 4,826,631 A * 5/1989 Sullivan ..... 252/512
5,196,267 A * 3/1993 Barder et al. ..... 423/339
5,789,027 A * 8/1998 Watkins et al. ..... 427/250
5,945,158 A * 8/1999 Djokic et al. ..... 427/216

FOREIGN PATENT DOCUMENTS

EP 0 453 107 A 10/1991
EP 0 453 107 A1 * 10/1991 ..... C23C/16/00
WO WO 99 19085 4/1999

OTHER PUBLICATIONS

Bocquet, J.F. et al., Surface and Coatings Technology, 70 (1994) pp. 73–78.
Sun, Ya–Ping et al., Chemical Physics Letters 288 pp. 585–588.
Louchev, O.A. et al., Journal of Crystal Growth 155 (1995) pp. 276–285.

* cited by examiner

*Primary Examiner*—Shrive P. Beck
*Assistant Examiner*—Elena Tsoy
(74) *Attorney, Agent, or Firm*—Burns, Doane, Swecker & Mathis, L.L.P.

(57) ABSTRACT

The invention relates to a method for coating particles thus obtained. According to the inventive method, the particles that are to be coated and at least one organo-metallic complex precursor of the coating material are brought into contact with each other in a liquid containing one or several solvents, whereby said particles are maintained in a dispersion in the liquid which is subjected to temperature conditions and supercritical pressure or slightly sub-critical pressure conditions; the precursor of the coating material is transformed in such a way that it is deposited onto the particles, whereupon the liquid is placed in temperature and pressure conditions so that it can eliminate the solvent in a gaseous state. The invention can be used to coat nanometric particles in paticular.

28 Claims, No Drawings

METHOD FOR COATING PARTICLES

The present invention relates to a process for coating particles and to the coated particles obtained.

Particles of the core-shell type provide two benefits. On the one hand, they make it possible to increase the specific surface area of a material by dispersing it in the form of nanoparticles, thus causing a significant increase in its activity, or to isolate a particle from other particles by a protective layer and thus to modify the properties of the medium. On the other hand, in the case of the production of organic, mineral or hybrid composites, the coating of the particles makes it possible for the particles to be made compatible with the matrix. Mention may be made, for example, of the use of nanometric magnetic particles for recording data in the data processing field. Mention may also be made of the use of particles as solder binder in the electronics field. In the medical field, magnetic particles coated with organic substances are used.

Various processes for depositing a thin layer on a substrate are known. Particularly effective processes use a fluid raised to a pressure and to a temperature which are above the normal conditions, and especially a fluid placed under conditions very close to the critical pressure and critical temperature. These processes consist in depositing a film on a plane substrate, generally heated, placed in a reactor, by means of a supercritical fluid containing a precursor of the compound constituting the film, said precursor being converted before being deposited on the substrate, and the solvent for the fluid being removed by reducing the pressure in the reactor.

For example, "Oleg A. Louchev, et al., J. of Crystal Growth 155 (1995), 276–285" describes a process consisting in depositing copper on a heated substrate consisting of a silicon grid placed in a reactor under high pressure, by means of a supercritical fluid containing copper hexafluoroacetylacetonate as copper precursor. Conversion of the precursor is obtained by heating to a temperature of around 600 to 800° C.; this results in pyrolysis of the organic part of the precursor, which contaminates the substrate with carbon and with oxygen.

"J. F. Bocquet, et al., Surface and Coatings Technology, 70 (1994), 73–78" describes a process for depositing a film of metal oxide ($TiO_2$) on a heated substrate placed in a reactor, using a supercritical solution of a $TiO_2$ precursor introduced into a pressurized reactor.

U.S. Pat. No. 5,789,027 (1996) describes a process for depositing a material on the surface of a substrate or within a porous solid. The process consists in dissolving a precursor of the material in a solvent under supercritical conditions, in bringing the substrate or the porous solid into contact with the supercritical solution, in adding a reactant which converts the precursor, thus causing the material to be deposited on the surface of the substrate or in the porous solid, and then in reducing the pressure in order to remove the solvent.

"Ya-Ping Sun, et al., Chemical Physics Letters 288 (1998), 585–588" describes the preparation of CdS nanoparticles coated with a film of polyvinylpyrrolidone. A solution of $Cd(NO_3)_2$ in ammonia, brought under supercritical temperature and pressure conditions, is subjected to rapid expansion at room temperature in a solution of $Na_2S$ which also contains polyvinylpyrrolidone (PVP). The expansion causes precipitation of the $Cd(NO_3)_2$ and makes the $Cd(NO_3)_2$ react with the $Na_2S$, thereby allowing CdS nanoparticles to form. Because the $Na_2S$ solution contains PVP, the CdS particles obtained are coated with PVP. This process makes it possible to prepare the particles in situ and at the same time to coat them. However, rapid expansion for the formation of particles to be coated is not very simple to implement as it involves passing a solution of particle precursors through a nozzle. A very small amount of material can be treated at each pass through the nozzle and the risks of blockage are not negligible. Furthermore, the rapid expansion is limited to particle precursors which may be dissolved in a supercritical solvent before the rapid expansion. Finally, the rapid expansion is obtained by a sudden drop in the pressure, which requires precise control of the nozzle temperature since the pressure reduction causes significant cooling.

It is an object of the present invention to provide a process allowing porous or nonporous particles to be simply and reliably coated with the aid of a precursor of the coating compound.

This is why the subject of the present invention is a process for depositing a film of a coating material on the surface of particles, or in the pores of porous particles, said process being characterized in that it consists in:

a) bringing, on the one hand, the particles to be coated and, on the other hand, an organometallic complex precursor of the coating material, optionally combined with one or more additional precursors which are organometallic complex or not, into contact in a fluid containing one or more solvents, said particles being kept dispersed in the fluid subjected to supercritical or slightly subcritical temperature and pressure conditions;

b) causing, within the fluid, the precursor of the coating material to be converted so that it is deposited on the particles;

c) bringing the fluid into temperature and pressure conditions such that the fluid is in the gaseous state in order to remove the solvent.

Within the context of the present invention, the term "particle" is understood to mean any object which has a mean size of less than one millimeter, whatever its shape. The process of the present invention is particularly suitable for coating particles of very small size, and especially for nanometric particles and micrometric particles, in particular for particles having a mean size of between 1 nm and 100 $\mu$m. The process is also very suited for coating particles having a complex shape. The particles may consist of a single chemical compound or by a mixture of compounds. The compounds may be mineral compounds, organic compounds or a mixture of organic or mineral compounds. The particles consisting of a mixture of compounds may be substantially homogeneous particles. However, they may also be heterogeneous particles in which the compound forming the core is different from the compound forming the external layer.

Within the context of the present invention, the fluid containing the particles to be coated and the precursor of the coating material is placed under supercritical or slightly subcritical temperature and pressure conditions. The term "supercritical conditions" is understood to mean conditions under which the temperature is above the critical temperature $T_c$ and the pressure is above the critical pressure $P_c$. The term "slightly subcritical conditions" is understood to mean temperature T and pressure P conditions such that all the gases of the reaction mixture are dissolved in the liquid phase. The supercritical or slightly subcritical conditions are defined with respect to the pressure and to the temperature at the critical point $P_c$ and $T_c$ of the entire fluid constituting the reaction mixture. They generally lie within the range $0.5<T_c/T<2$, $0.5<P_c/P<3$. The reaction mixture consists of one or more solvents and various compounds in solution or in suspension. To a first approximation, the critical temperature and the critical pressure of such a fluid may be considered to be very close to those of the predominant solvent present in the fluid, and the supercritical or slightly subcritical conditions are defined with respect to the critical temperature and pressure of said predominant solvent. In general, the temperature of the fluid will be between 50° C. and 600° C., preferably between 100° C. and 300° C., and the pressure of the fluid will be between 0.2 MPa and 60 MPa, preferably between 0.5 MPa and 30 MPa. The particular values are chosen according to the precursor of the coating material.

The particles to be coated are kept dispersed in the reaction mixture by mechanical stirring, by natural convection or by forced convection, by the action of ultrasonics, by the creation of a magnetic field, by the creation of an electric field, or by a combination of several of these means. When the particles are kept dispersed by means of ultrasonics, it is preferred to use power ultrasonics, the frequency of which is from 20 kHz to 1 MHz. When the particles are kept dispersed by means of a magnetic field, a DC or AC magnetic field having an intensity of less than or equal to 2 tesla is imposed on the reaction mixture.

The reaction mixture essentially consists of one or more solvents in which the precursor of the coating material is dissolved and the particles are in suspension. As solvent, it is possible to use a compound which is either gaseous or liquid under standard temperature and pressure conditions, that is to say at 25° C. and 0.1 MPa. For example, the solvent may be water or an organic solvent which is liquid under standard temperature and pressure conditions, or a mixture of such solvents. Among solvents which are liquid under standard temperature and pressure conditions, mention may be made of alkanes which have from 5 to 20 carbon atoms and which are liquid under standard temperature and pressure conditions, more particularly n-pentane, isopentane, hexane, heptane and octane; alkenes having from 5 to 20 carbon atoms; alkynes having from 4 to 20 carbon atoms; alcohols, more particular methanol and ethanol; ketones, in particular acetone; liquid ethers, esters, chlorinated hydrocarbons and fluorinated hydrocarbons; solvents resulting from petroleum cuts, such as white spirit, and mixtures thereof. Among solvents which are gaseous under standard temperature and pressure conditions, mention may be made of carbon dioxide, ammonia, helium, nitrogen, nitrous oxide, sulfur hexafluoride, gaseous alkanes having 1 to 5 carbon atoms, (such as methane, ethane, propane, n-butane, isobutane and neopentane), gaseous alkenes having from 2 to 4 carbon atoms (such as acetylene, propane and 1-butyne), gaseous dienes (such as propydiene), fluorinated hydrocarbons and mixtures thereof. The solvent itself may in certain cases constitute a precursor of the coating material.

The organometallic complex precursor of the coating material may be chosen from the acetylacetonates of various metals, which make it possible to obtain coatings of various types depending on the reaction conditions. In the strict absence of oxygen, a metallic coating is obtained. In the presence of an oxidizer, such as $O_2$, $H_2O_2$ or $NO_2$ for example, an oxide coating is obtained. In ammoniacal medium, a nitride coating is obtained. Copper acetylacetonate or copper hexafluoroacetylacetonate are advantageously used to obtain copper or copper oxide $Cu_2O$ coatings. As additional precursor, it is possible to combine with the organometallic complex precursor any compound capable of participating in the formation of the coating material. This may be a second compound of an organometallic complex, or a different compound which may or may not react with the organometallic complex compound. By way of example, mention may be made of the use of $Cu(hfa)_2$ dissolved in ammonia, the ammonia solvent acting as reactant for the formation of copper nitride from the $Cu(hfa)_2$ precursor. The process of the invention thus makes it possible to obtain particles whose core has a diameter between 1 nm and 1 $\mu$m and consists of nickel, silica, iron oxide or an $SmCo_5$ alloy, which are coated with copper, copper oxide or copper nitride.

The chemical conversion of the precursor or precursors present in the reaction mixture may be carried out either thermally or by means of a chemical reaction, depending on the nature and the reactivity of the precursor. When the reaction mixture contains several precursors of the coating material, the various precursors may be converted at the same time or in succession, depending on their nature and their reactivity. A solvent may constitute one precursor.

In one particular method of implementing the process of the invention, the following steps are carried out:

- a fluid comprising at least one precursor of the coating material dissolved in a solvent $S_1$ is prepared;
- the fluid is subjected to supercritical or slightly subcritical temperature and pressure conditions;
- said fluid is brought into contact with the particles to be coated, which are dispersed in a solvent $S_2$, and pressure and temperature conditions suitable for causing the conversion of the precursor are imposed on the reaction mixture, the particles being kept dispersed;
- the reaction mixture undergoes a pressure reduction in order to remove the solvents.

In another method of implementing the process of the invention, the following steps are carried out:

- a fluid containing at least one precursor of the coating material dissolved in a solvent $S_1$ is prepared;
- the fluid is brought under supercritical or slightly subcritical temperature and pressure conditions;
- said fluid is brought into contact with the particles to be coated, these being dispersed in a solvent $S_2$, the particles being kept dispersed, one or more additives capable of reacting with the precursor or precursors of the coating material are added and then temperature and pressure conditions capable of causing the conversion of the precursor are imposed on the reaction mixture;
- the reaction mixture undergoes a pressure reduction in order to remove the solvents.

In both methods of implementation described above, the solvents $S_1$ and $S_2$ may be identical or different. A third solvent may be introduced into the fluid in order to improve the operating conditions, especially in order to reduce the critical temperature and critical pressure of the fluid, in order to increase the solubility of the precursor or precursors, or to reduce the conversion temperature of the precursor or precursors. A variant of these methods of implementation consists in bringing the fluid containing the precursor into contact with the particles to be coated before the fluid is brought under supercritical or slightly subcritical conditions.

In a third method of implementing the process of the invention, the particles to be coated may be prepared in situ. The reaction fluid then contains one or more precursors of the particles and one or more precursors of the coating material. It is possible to use precursors which are converted by the action of heat, the precursors of the particles having a conversion temperature below that of the precursors of the coating materials. It is also possible to use precursors which are converted by a chemical reaction with an additional reactant, provided that the conversion of the precursor of the particles takes place first.

In this case, the following steps are carried out:

a fluid comprising at least one precursor of the particles to be coated, dissolved in a solvent $S_2$, is prepared;

said fluid is brought under supercritical or slightly subcritical temperature and pressure conditions;

the particles are formed by modifying the precursor or precursors, either by an increase in the temperature or by the action of a suitable reactant, and the particles formed are kept dispersed;

a fluid comprising at least one precursor of the coating material, dissolved in a solvent $S_1$ is prepared;

the fluid containing the particles to be coated is brought into contact with the fluid containing the precursor or precursors of the coating material under supercritical or slightly subcritical temperature and pressure conditions, to ensure that they are well dissolved, and then the reaction mixture is subjected to conditions suitable for causing the conversion of the precursor of the coating material;

next, the reaction mixture undergoes a pressure reduction in order to remove the solvents.

In this method of implementation, it is also possible to add one or more additional solvents to the various fluids so as to adjust the properties of the reaction mixture. Likewise, it is possible to use, where appropriate, the same solvent for the fluid containing the precursor of the particles and for the fluid containing the precursor of the coating material. .This method of implementation includes several variants. The precursor of the particles may be converted either by a heat treatment or by the addition of a suitable reactant. Likewise, the precursor of the coating material may be converted either by a heat treatment or by the addition of a suitable reactant. The fluids may be placed under supercritical or slightly subcritical conditions when they contain all their constituents or when they contain some of them. The condition common to all the variants is that the reaction mixture is under supercritical or slightly subcritical conditions at the moment when the precursor of the coating material is chemically converted.

The process of the invention may be implemented in order to deposit several coating layers on particles. For this purpose, all that is required is to introduce into the reaction mixture several precursors having a different reactivity and to impose on the reaction mixture, in succession, the conditions appropriate for causing the stepwise conversion of the precursors.

The process of the invention may be carried out continuously or in batch mode.

The present invention is explained in greater detail by the following examples. However, the invention is not limited to these examples, which are given as illustration.

EXAMPLE 1

Nickel Beads Coated with Copper Oxide

For this example, the following were used:

nickel beads having a mean size of between 3 and 5 $\mu$m;

copper hexafluoroacetylacetonate $Cu(hfa)_2$ as precursor of copper oxide $CU_2O$;

a high-pressure stainless steel reactor.

The $Cu(hfa)_2$ precursor and the nickel powder to be coated were dry blended and the mixture was introduced into the high-pressure reactor. Next, a $CO_2$/ethanol liquid mixture, with a 80/20 molar composition, was added. The whole was brought under supercritical conditions, namely a temperature of 130° C. and a pressure of 18 MPa, in order to ensure that the precursor was properly dissolved. Next, the reaction mixture was heated to a temperature of 200° C. at constant pressure and held at this temperature for 60 min., which resulted in the complete thermal decomposition of $Cu(hfa)_2$ and deposition of $Cu_2O$ on the nickel particles. Throughout this period of the process, the nickel particles were kept moving by natural convection. The convection was obtained by creating a temperature gradient between the upper part of the reactor and the lower part.

At the end of the conversion, oxygen, as oxidizing agent, was introduced into the reactor, resulting in the oxidation of the copper layer. Next the pressure in the reactor was reduced at constant temperature, which resulted in the removal of the solvent, and the dry, coated powder uncontaminated with solvent was recovered.

The copper oxide coating on the nickel particles was examined by electron microscopy and by X-rays. The quality of coating was checked by electron etching followed by Auger analysis.

Magnetic measurements carried out on the powder of initially uncoated nickel particles and on the final powder of coated particles showed that the coating considerably enhances the magnetic coercivity of the particles.

Analysis of the X-ray diffraction pattern gave the following results:

| d in Å | Intensity | Nature |
|---|---|---|
| 2.46 | 100 | $Cu_2O$ |
| 2.12 | 37 | $Cu_2O$ |
| 2.03 | 10 | Ni |
| 1.75 | 42 | Ni |
| 1.50 | 27 | $Cu_2O$ |
| 1.24 | 21 | Ni |

The intensity was determined by comparison with crystallographic data (especially the d values and the intensities relating to this parameter) which are catalogued in the JCPDS files.

EXAMPLE 2

Beads of $SmCo_5$ Alloy Coated with Copper Oxide

According to an operating procedure similar to that of example 1, using an identical solvent and the same temperature and pressure conditions, beads, made of a samarium-cobalt alloy, coated with copper oxide were prepared.

The $SmCo_5$ alloy powder used was a powder screened to 20 $\mu$m.

The copper oxide coating on the $SmCo_5$ particles was examined by electron microscopy and by X-rays.

Magnetic measurements carried out on the $SmCo_5$ powder showed that the coating enhances the magnetic coercivity of the specimen.

EXAMPLE 3

Silica Beads Coated with Copper Oxide

According to an operating procedure similar to that of example 1, using an identical solvent and the same temperature and pressure conditions, beads made of silica and coated with copper oxide were prepared.

The copper oxide coating on the silica particles was examined by electron microscopy and by X-rays.

EXAMPLE 4

Nickel Beads Coated with Copper

A layer of metallic copper was deposited on nickel beads by the thermal decomposition of copper hexafluoroacetylacetonate $Cu(hfa)_2$ in a supercritical $CO_2$/ethanol mixture. $Cu(hfa)_2$ was chosen as precursor because of its high solubility in the $CO_2$/ethanol mixture.

The starting products used were commercially available products. Nickel beads having a diameter of between 3 and 5 $\mu$m were used.

The precursor was blended with the powder to be coated, then the mixture was placed in a high-pressure stainless steel cell and the solvent consisting of the $CO_2$/ethanol mixture. with an 80/20 molar composition was introduced into the cell. The whole was taken to supercritical conditions (T=130° C.; P=20 MPa) in order to ensure that the precursor was properly dissolved. A rapid rise in the temperature ($\Delta$T=70° C.) at constant pressure made it possible for the precursor to thermally decompose and for the beads to be coated. The beads were kept moving in the supercritical medium by natural convection resulting from maintaining a temperature gradient in the cell. Next, the $CO_2$ solvent was replaced with pressurized nitrogen, and then the reaction mixture was left to return to room temperature in an inert atmosphere. By simply reducing the pressure on the solvent, the dry powder, uncontaminated with solvent, was recovered.

The metallic copper coating on the nickel particles was examined by electron microscopy and X-rays.

Magnetic measurements carried out on the nickel powder and on the final powder showed that the coating enhances the magnetic coercivity of the specimen.

EXAMPLE 5

Iron Oxide Beads Coated with Copper

Firstly, an iron oxide powder was prepared by the decomposition of iron acetate $Fe(ac)_2$ in a supercritical fluid, in which the solvent was a $CO_2$/ethanol mixture with an 80/20 molar composition.

The 80/20 $CO_2$/ethanol mixture containing iron acetate was taken to supercritical conditions (T=100° C.; P=200 bar) in order to ensure that the iron acetate was properly dissolved. A rapid temperature rise ($\Delta$T=70° C.) allowed the acetate to thermally decompose and the iron oxide beads to form. The beads were kept moving in the supercritical medium by natural convection resulting from maintaining a temperature gradient in the cell. Next, the reaction mixture was left to return to room temperature. By simply reducing the pressure of the solvent, the dry iron oxide powder, uncontaminated with solvent, was recovered.

Secondly, the iron oxide powder thus obtained was coated by means of copper hexafluoroacetylacetonate using the operating procedure of example 4. The conditions were as follows: T=130° C., P=180 bar, $\Delta$T=70° C.

The metallic copper coating on the iron oxide particles was examined by electron microscopy and X-rays.

EXAMPLE 6

In situ Formation and Coating of Iron Oxide Beads with Copper

Copper hexafluoroacetylacetonate (a copper precursor) and iron acetate (iron oxide bead precursor) were introduced into an 80/20 $CO_2$/ethanol mixture. The mixture was taken to the following supercritical conditions: T=130° C., P=200 bar in order to ensure that the precursors were properly dissolved. Since the decomposition temperature of the iron oxide precursor is below that of the copper precursor, the iron oxide precursor decomposed first, in order to form small iron oxide aggregates. Next, the copper precursor decomposed and the copper formed was deposited on the in situ formed iron oxide aggregates.

The metallic copper coating on the iron oxide particles was examined by electron microscopy and by X-rays.

EXAMPLE 7

Copper Nitride Coating on Nickel Beads

The copper precursor $Cu(hfa)_2$ was blended with nickel beads having a diameter of between 3 and 5 $\mu$m. The mixture was introduced into a high-pressure stainless steel cell and liquid ammonia solution was added. The whole was then taken to the following supercritical conditions: T=160° C., P=20 MPa, in order to ensure that the precursor was properly dissolved. A rapid temperature rise ($\Delta$T=40° C.) at constant pressure caused the precursor to react with the ammonia solution, in order to form copper nitride, and cause the beads to be coated. The beads were kept moving in the supercritical medium by natural convection, as indicated in example 1. The reaction mixture was then left to return to room temperature, under $NH_3$ pressure, and then, by simply reducing the pressure, the dry coated powder uncontaminated with solvent was recovered.

What is claimed is:

1. A process for depositing a film of a coating material on the surface of particles, or in the pores of porous particles, said process comprising:

a) bringing, on the one hand, the particles to be coated and, on the other hand, an organometallic complex precursor of the coating material, combined with one or more additional precursors optionally being an organometallic complex, into contact in a fluid containing one or more solvents, said particles being kept dispersed in the fluid subjected to supercritical or slightly subcritical temperature and pressure conditions;

b) causing, within the fluid, the precursors of the coating material to be converted in succession so that they are deposited on the particles; and c) bringing the fluid into temperature and pressure conditions such that the fluid is in the gaseous state in order to remove the solvent.

2. The process as claimed in claim 1, wherein at least one of the precursors of the coating material is converted by thermal means.

3. The process as claimed in claim 1, wherein at least one of the precursors of the coating material is converted by means of a chemical reaction.

4. The process as claimed in claim 1, wherein the solvent is chosen from compounds which are either gaseous or liquid under standard temperature and pressure conditions.

5. The process as claimed in claim 4, wherein the solvent is chosen from water, alkanes having from 5 to 20 carbon atoms, alkenes having from 5 to 20 carbon atoms, alkynes having from 4 to 20 carbon atoms, alcohols, ketones, liquid ethers, esters, chlorinated hydrocarbons, fluorinated hydrocarbons, solvents resulting from petroleum cuts, which are liquid under standard temperature and pressure conditions, or mixtures thereof.

6. The process as claimed in claim 4, wherein the solvent is chosen from carbon dioxide, ammonia, helium, nitrogen, nitrous oxide, sulfur hexafluoride, gaseous alkanes having from 1 to 5 carbon atoms, gaseous alkenes having from 2 to 4 carbon atoms, gaseous dienes, fluorinated hydrocarbons, or mixtures thereof.

7. The process as claimed in claim 1, wherein the particles to be coated are introduced into a fluid which comprises at least one precursor of the coating material dissolved in a solvent $S_1$ and which is subjected to supercritical or slightly subcritical temperature and pressure conditions.

8. The process as claimed in claim 1, wherein the particles to be coated are prepared in situ.

9. The process as claimed in claim 8, wherein a fluid containing at least one precursor of the particles to be coated is prepared, said fluid is subjected to supercritical or slightly subcritical temperature and pressure conditions, the particles are formed by modifying the precursor or precursors and are kept dispersed, and the particles formed are brought into contact with a fluid subjected to supercritical temperature and pressure conditions and containing at least one precursor of the coating material.

10. The process as claimed in claim 1, wherein the precursor of the coating material is chosen from metal acetylacetonates.

11. The process as claimed in claim 1, wherein the precursor of the coating material is chosen from copper acetylacetonate or copper hexafluoroacetylacetonate.

12. The process as claimed in claim 1, wherein a metal coating is deposited, and the reaction mixture is free of oxygen.

13. The process as claimed in claim 1, wherein a metal oxide coating is deposited, and the reaction mixture contains an oxidizer.

14. Coated particles obtained by a process as claimed in claim 1.

15. A process for depositing a film of a coating material on the surface of particles, or in the pores of porous particles, said process comprising:

a) bringing, on the one hand, the particles to be coated and, on the other hand, an organometallic complex precursor of the coating material, optionally combined with one or more additional precursors which may be organometallic complex or not, into contact in a fluid containing one or more solvents and an ammonia solution, said particles being kept dispersed in the fluid subjected to supercritical or slightly subcritical temperature and pressure conditions;

b) causing, within the fluid, the precursor of the coating material to be converted so that it is deposited on the particles; and c) bringing the fluid into temperature and pressure conditions such that the fluid is in the gaseous state in order to remove the solvent.

16. The process as claimed in claim 15, wherein the precursor of the coating material is converted by thermal means.

17. The process as claimed in claim 15, wherein the precursor of the coating material is converted by means of a chemical reaction.

18. The process as claimed in claim 15, wherein the solvent is chosen from compounds which are either gaseous or liquid under standard temperature and pressure conditions.

19. The process as claimed in claim 18, wherein the solvent is chosen from water, alkanes having from 5 to 20 carbon atoms, alkenes having from 5 to 20 carbon atoms, alkynes having from 4 to 20 carbon atoms, alcohols, ketones, liquid ethers, esters, chlorinated hydrocarbons, fluorinated hydrocarbons, solvents resulting from petroleum cuts, which are liquid under standard temperature and pressure conditions, or mixtures thereof.

20. The process as claimed in claim 18, wherein the solvent is chosen from carbon dioxide, ammonia, helium, nitrogen, nitrous oxide, sulfur hexafluoride, gaseous alkanes having from 1 to 5 carbon atoms, gaseous alkenes having from 2 to 4 carbon atoms, gaseous dienes, fluorinated hydrocarbons, or mixtures thereof.

21. The process as claimed in claim 15, wherein the particles to be coated are introduced into a fluid which comprises at least one precursor of the coating material dissolved in a solvent $S_1$ and which is subjected to supercritical or slightly subcritical temperature and pressure conditions.

22. The process as claimed in claim 15, wherein the particles to be coated are prepared in situ.

23. The process as claimed in claim 22, wherein a fluid containing at least one precursor of the particles to be coated is prepared, said fluid is subjected to supercritical or slightly subcritical temperature and pressure conditions, the particles are formed by modifying the precursor or precursors and are kept dispersed, and the particles formed are brought into contact with a fluid subjected to supercritical temperature and pressure conditions and containing at least one precursor of the coating material.

24. The process as claimed in claim 15, wherein the fluid contains several precursors of coating materials, which are converted in succession.

25. The process as claimed in claim 15, wherein the precursor of the coating material is chosen from metal acetylacetonates.

26. The process as claimed in claim 15, wherein the precursor of the coating material is chosen from copper acetylacetonate or copper hexafluoroacetylacetonate.

27. The process as claimed in claim 15, wherein a metal coating is deposited and the reaction mixture is free of oxygen.

28. Coated particles obtained by a process as claimed in claim 15.

* * * * *